US006655235B2

(12) United States Patent
Sawyer et al.

(10) Patent No.: US 6,655,235 B2
(45) Date of Patent: Dec. 2, 2003

(54) FUSE TOOL

(75) Inventors: Michael Sawyer, Riverview, FL (US); Matthew Kusz, Minneapolis, MN (US); Charles G. Ham, Mound, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 235 days.

(21) Appl. No.: 09/851,799

(22) Filed: May 9, 2001

(65) Prior Publication Data

US 2002/0166415 A1 Nov. 14, 2002

(51) Int. Cl.[7] ..... B25B 27/14
(52) U.S. Cl. ..... 81/3.8; 81/427; 81/3.1
(58) Field of Search ..... 81/3.8, 53.1, 355, 81/424.5, 427

(56) References Cited

U.S. PATENT DOCUMENTS

| | | | | |
|---|---|---|---|---|
| 981,857 A | | 1/1911 | Hubbard et al. | |
| 1,346,022 A | | 7/1920 | Hassel | |
| 1,363,515 A | * | 12/1920 | Knoss, Jr. | 81/3.8 |
| 1,429,852 A | * | 9/1922 | Dyer et al. | 81/3.8 |
| 1,430,053 A | | 9/1922 | Bush | |
| 1,531,567 A | | 3/1925 | Niblock | |
| 1,927,528 A | | 9/1933 | Nilsson | |
| 2,418,773 A | | 7/1947 | Kahanek | |
| 2,430,544 A | * | 11/1947 | Walker | 81/3.8 |
| 2,454,878 A | | 11/1948 | Marler | |
| 2,716,910 A | * | 9/1955 | Guerinet | 81/3.8 |
| 2,924,481 A | | 2/1960 | Wagstaff | |
| 3,195,380 A | | 7/1965 | Bicks | |
| 3,534,993 A | | 10/1970 | Le Vesque, Sr. | |
| 5,800,043 A | | 9/1998 | Walkerow | |

* cited by examiner

*Primary Examiner*—Joseph J. Hail, III
*Assistant Examiner*—David B. Thomas
(74) *Attorney, Agent, or Firm*—Fogg and Associates, LLC; Laura A. Ryan

(57) ABSTRACT

A tool for installing and extracting a fuse is provided. The tool has a first bar that has a jaw at one end of the first bar. The tool has second bar that is slidably attached to the first bar and that has a jaw at one end of the second bar. The respective jaws are adapted to align by sliding the respective bars relative to each other to retain the fuse between the respective jaws.

135 Claims, 16 Drawing Sheets

FUSE TOOL

TECHNICAL FIELD

The present invention relates generally to the field of tools and, in particular, to a tool that can be used to install and extract fuses.

BACKGROUND

Fuses are often difficult to extract or install without using a tool because of their location or because of the force required to perform the installation or extraction. For example, many of the environmentally protected housings used by the telecommunications industry are located on utility poles or suspended from cables and contain a multitude of fuses. Typically, these fuses are accessible through access ports that are often smaller than the average adult hand and are often located several inches from the plane of the access port. Moreover, the fuses often have exposed electrically charged surfaces and/or are often surrounded by electrically charged surfaces.

Frequently, tools that are made from electrical conducting materials, that apply incorrect forces to the fuse, or the like are used for installing or extracting fuses, e.g., "needle-nose" pliers, screwdrivers, or the like. Using tools made from electrically conducting materials frequently cause the user to receive electrical shocks, cause electrical shorts that often damage electrical equipment, or the like. Using tools that apply incorrect forces frequently damage the fuses or the equipment to which the fuses are coupled or do not enable the installation or extraction of the fuse. Moreover, many of the tools conventionally used for installing and extracting fuses often require the user to use both hands and/or to apply a continuous force to the tool to maintain engagement of the tool and fuse. This is undesirable and causes safety issues when changing fuses located in housings that are located on utility poles or suspended from cables.

For the reasons stated above, and for other reasons stated below which will become apparent to those skilled in the art upon reading and understanding the present specification, there is a need in the art for tools for installing or extracting fuses that reduce the user's risk for electrical shocks, reduce the risk of electrical shorts, can be operated with one hand, and do not require the user to apply a continuous force to maintain engagement between the tools and the fuses.

SUMMARY

The above-mentioned problems with the tools used to install and extract fuses and other problems are addressed by embodiments of the present invention and will be understood by reading and studying the following specification. Embodiments of the present invention provide tools for installing and extracting fuses that reduce the user's risk for electrical shocks, reduce the risk of electrical shorts, can be operated with one hand, and do not require the user to apply a continuous force to the tools to maintain engagement between the tools and the fuses.

More particularly, in one embodiment, a tool for installing and extracting a fuse is provided. The tool has a first bar that has a jaw at one end of the first bar. The tool has second bar that is slidably attached to the first bar and that has a jaw at one end of the second bar. The respective jaws are adapted to align by sliding the respective bars relative to each other to retain the fuse between the respective jaws.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the present invention provide tools for installing and extracting fuses that reduce the user's risk for electrical shocks, reduce the risk of electrical shorts, can be operated with one hand, and do not require the user to apply a continuous force to the tool to maintain engagement between the tool and the fuse.

Figure 1A:
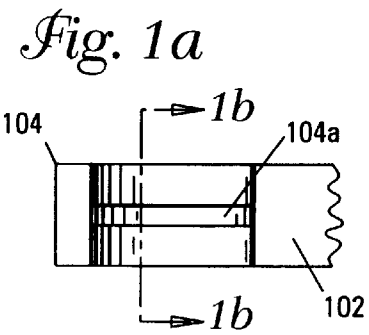
FIG. 1*a* is the embodiment of FIG. 1 viewed along line 1*a*—1*a* of FIG. 1.
Figure 1B:
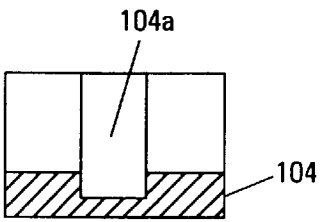
FIG. 1*b* is the embodiment of FIG. 1 viewed along line 1*b*—1*b* of FIG. 1*a*.
Figure 1:
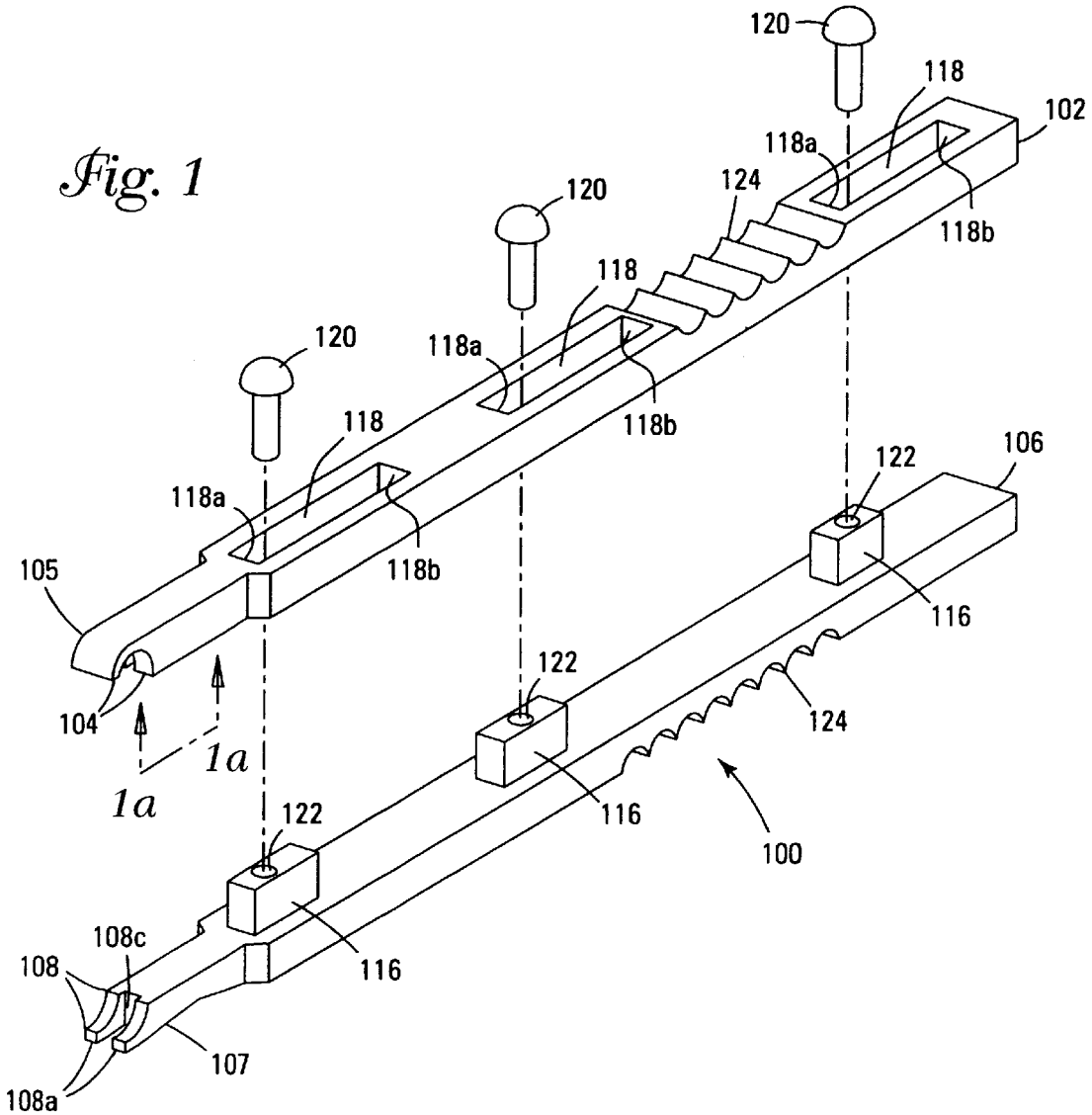
FIG. 1 is an exploded view of a first embodiment of the present invention.

A first embodiment of the present invention is exemplified by tool 100 in FIG. 1, an exploded view of tool 100. Tool 100 includes bar 102 that has jaw 104 at end 105 of bar 102. Tool 100 includes bar 106 that is slidably attached to bar 102 and that has jaw 108 at end 107 of bar 106. Jaws 104 and 108 are adapted to align by sliding bars 102 and 106 relative to each other to retain fuse 110 between jaws 104 and 108, as demonstrated in FIGS. 6*a*-6*c*. Jaws 104 and 108 are actuated out of alignment by sliding bars 102 and 106 relative to each other to remove fuse 110 from jaws 104 and 108 or to ready tool 100 for positioning fuse 110 between jaws 104 and 108 (see FIGS. 2*a*, 2*b*, 2*d*, 7, 8*a* and 8*i*).

Jaw 104 and bar 102 are integral and can be fabricated from any electrically nonconducting material having a suitable resiliency, such as glass-filled polycarbonate, glass-filled nylon, or the like. Likewise, jaw 108 and bar 106 are integral and can be fabricated from any electrically nonconducting material having a suitable resiliency, such as glass-filled polycarbonate, glass-filled nylon, or the like.

Figures 2A, 2B:
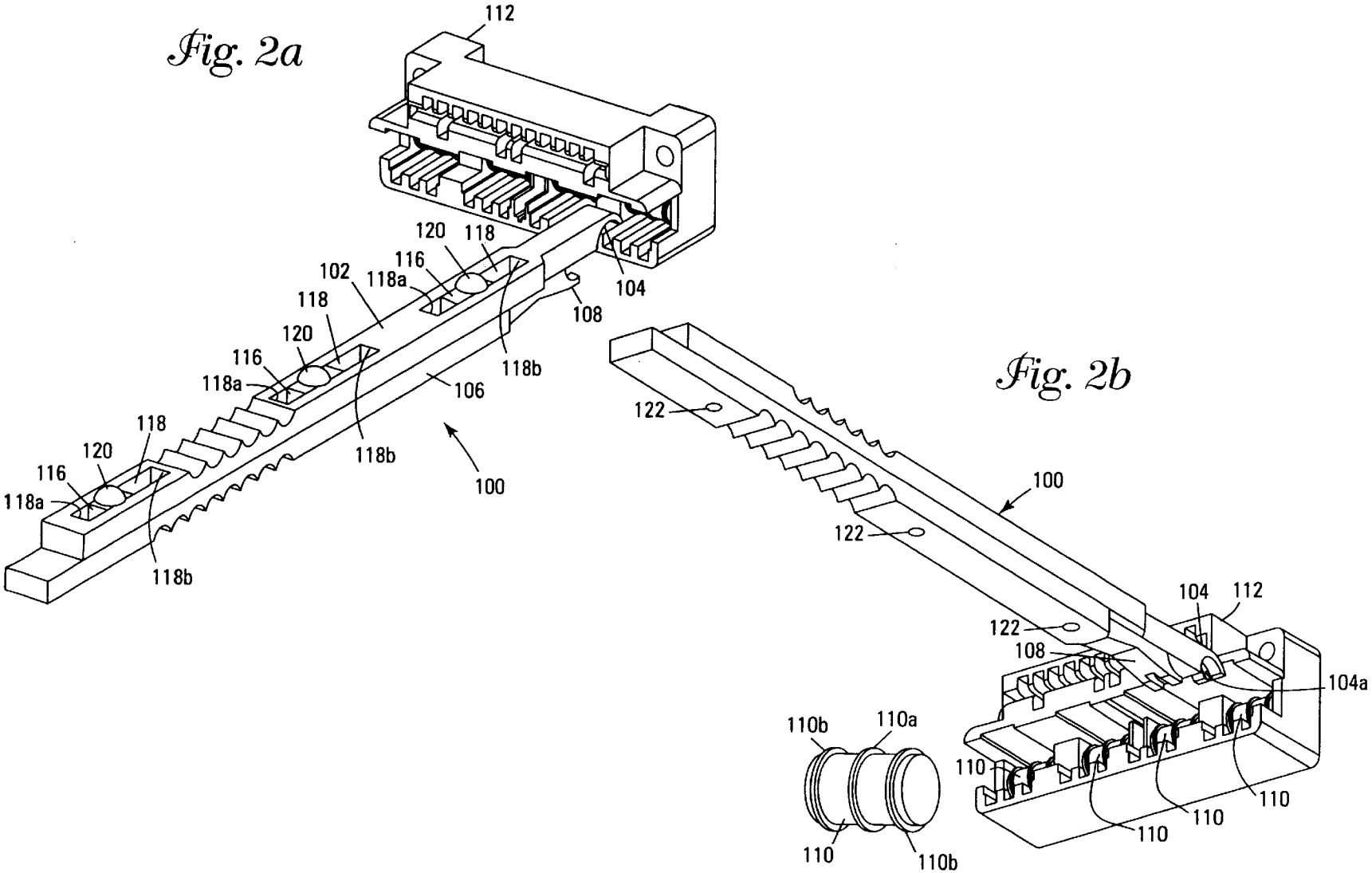
FIG. 2*a* is a top perspective-view of an embodiment of the present invention prior to insertion into a fuse protector-mount.
FIG. 2*b* is a bottom perspective-view of an embodiment of the present invention prior to insertion into a fuse protector-mount.
Figure 2C:
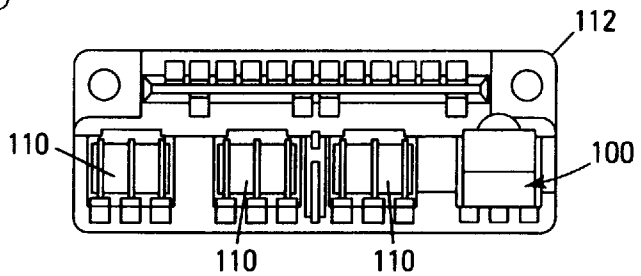
FIG. 2*c* is a front elevation view of an embodiment of the present invention prior to insertion into a fuse protector-mount.

Fuse 110 is demonstrated in FIG. 2*b*. Fuse 110 has central contact ring 110*a* that encircles and protrudes from the circumference of fuse 110 and a pair of contact rings 100*b* that encircle and protrude from the circumference of fuse 110 adjacent each of its ends. Contact rings 110*a* and 110*b* electrically couple fuse 110 to various electrical circuits. In some applications, fuse 110 has three electrical leads instead of three contact rings. Fuse 110 is placeable in protector-mount 112 (see FIGS. 2*b*, 2*c*, and 2*d*). In one application, protector-mounts 112 are used to mount fuses 110 within environmentally protected housings, such as those used by the telecommunications industry.

Figure 5A:
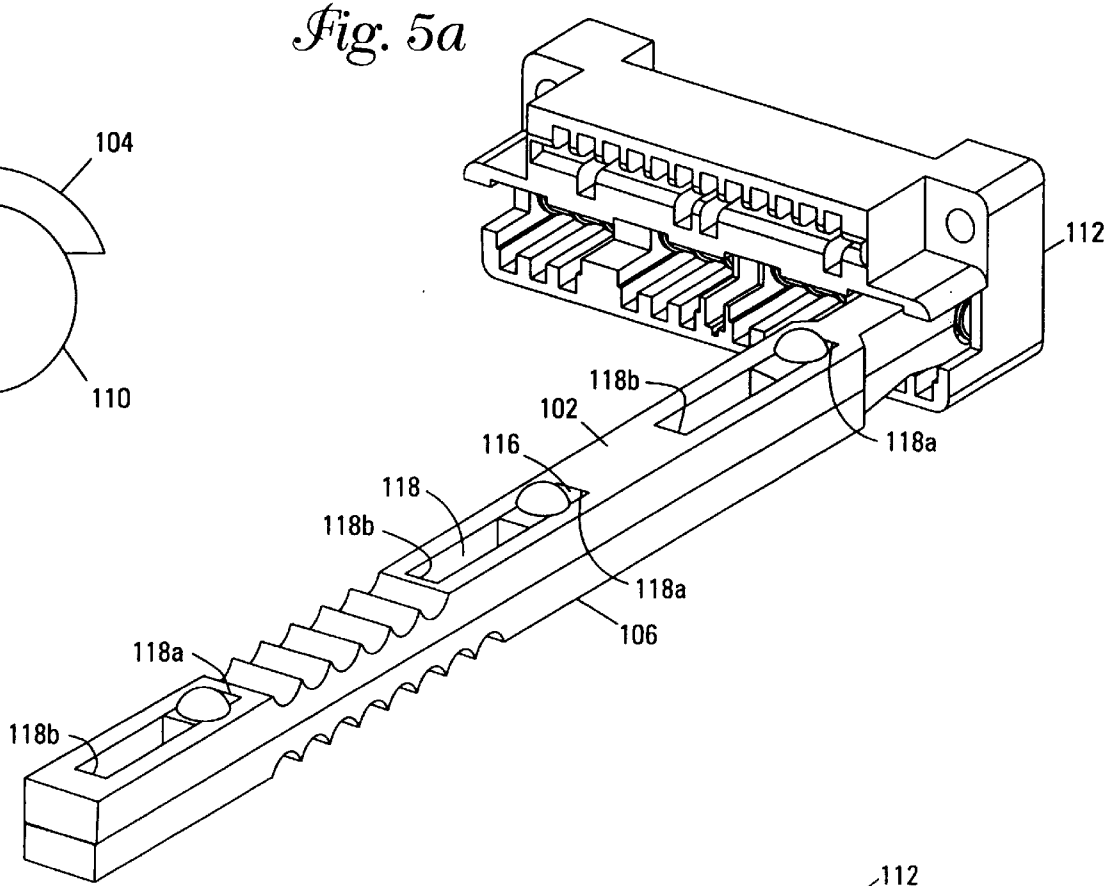
FIG. 5*a* is a top perspective-view of an embodiment of the present invention as inserted into a fuse protector-mount and retaining a fuse.
Figures 6A, 6B:
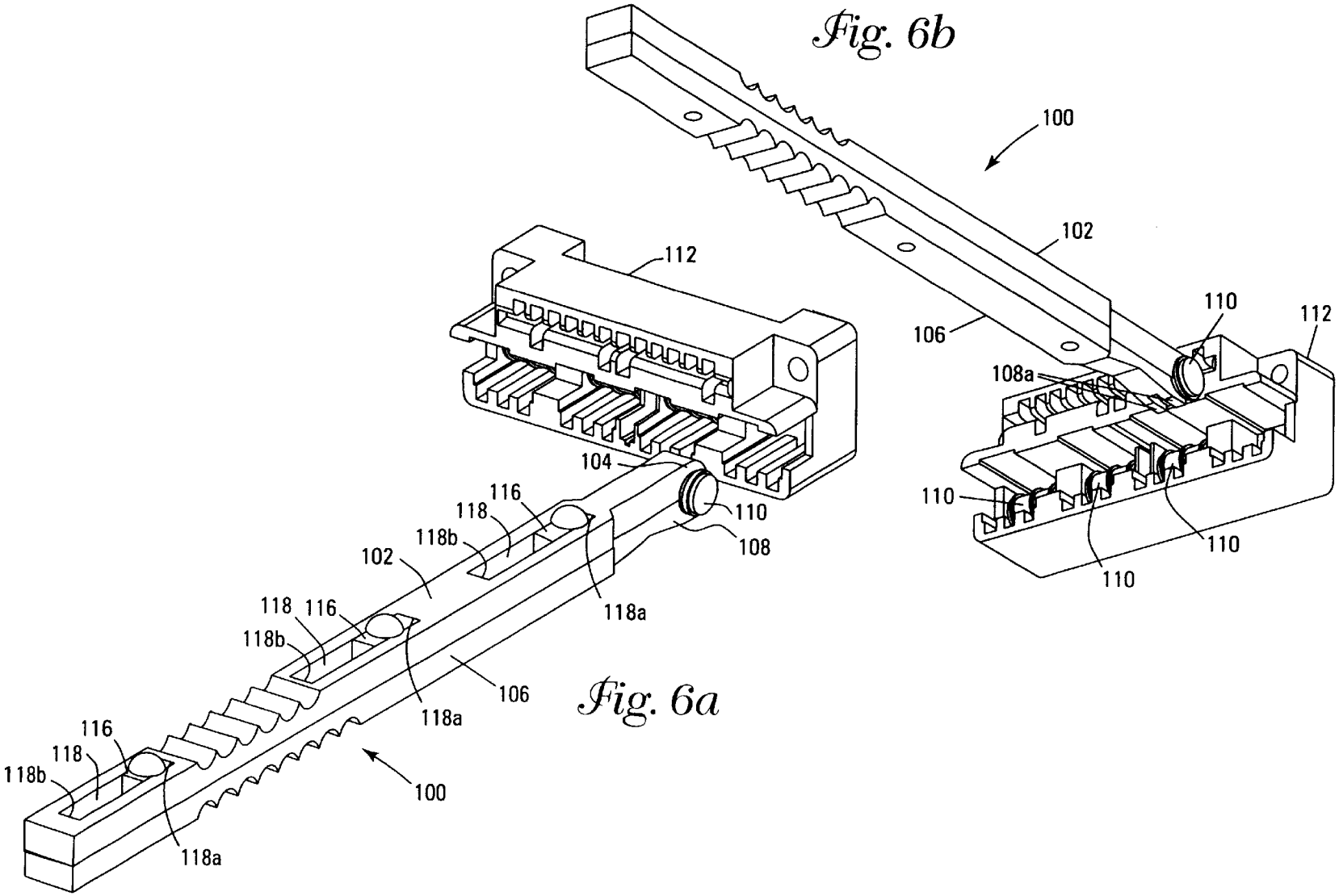
FIG. 6*a* is a top perspective-view of an embodiment of the present invention after extracting a fuse from a fuse protector-mount and retaining the fuse.
FIG. 6*b* is a bottom perspective-view of an embodiment of the present invention after extracting a fuse from a fuse protector-mount and retaining the fuse.

Bar 106 is slidably attached to bar 102 by butting bars 106 and 102 together so that protrusions 116 of bar 106 extend into slots 118 of bar 102, as shown in FIGS. 2*a*, 5*a*, and 6*a*. Slots 118 each have ends 118*a* and 118*b* that are opposite each other, as shown in FIGS. 1, 2*a*, 5*a*, and 6*a*. Slots 118 and protrusions 116 are respectively distributed along the lengths of bars 102 and 106 so that each protrusion 116 bears against end 118*a* of the corresponding slot 118 when jaws 104 and 108 are aligned (see FIG. 6*a*). The distance between ends 118*a* and 118*b* of each slot 118 is greater than the longitudinal extent of protrusions 116, as seen in FIGS. 1, 2*a*, 5*a*, and 6*a*. This enables each of protrusions 116 to move between ends 118*a* and 118*b* of the corresponding slot, thus enabling bars 102 and 106 to slide relative to each other. Note that the distance between ends 118*a* and 118*b* determines the extent to which jaws 104 and 108 are actuated out of alignment by sliding bars 102 and 106 relative to each other.

Fasteners 120 are inserted into apertures 122 of protrusions 116, as shown in FIG. 1, to maintain slidable contact between bars 102 and 106, as shown in FIG. 2*a*. In one embodiment, protrusions 116 and bar 106 are integral. In another embodiment, protrusions 116 are glued to bar 106. Although the protrusions 116 shown in FIGS. 1 and 2*a* are rectangular blocks, they can be square blocks, cylinders, or the like. In one embodiment, fasteners 120 are pressed into apertures 122. In another embodiment, fasteners 120 are threaded into apertures 122.

Figure 2D:
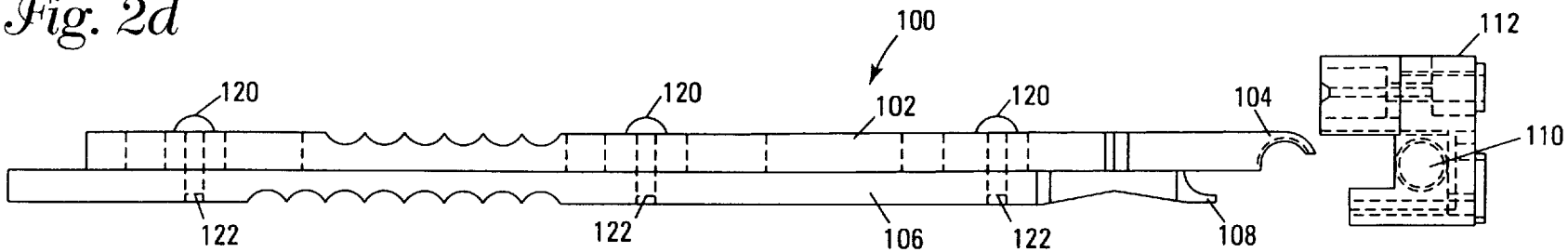
FIG. 2*d* is a side elevation view of an embodiment of the present invention prior to insertion into a fuse protector-mount.

Apertures 122 extend through protrusions 116 and through bar 106, as shown in FIGS. 2*b* and 2*d*. In another embodiment, apertures 122 terminate in bar 122. In another embodiment, apertures 122 terminate in protrusions 116. Although tool 100 is shown to have three protrusions 116 and three slots 118, other embodiments have a single slot 118 and a single protrusion 116, two slots 118 and two protrusions 116, etc. In another embodiment bearings, e.g., roller, ball, or the like, are disposed between bars 102 and 106.

Jaws 104 and 108 have arced profiles (see FIG. 1, FIGS. 2*a* and 2*d* and FIG. 6*c*) that have substantially the same radii. The radii of jaws 104 and 108 are substantially the same as the radius of fuse 110. Jaws 104 and 108 are sufficiently resilient to accommodate variations in the fuse radius, such as variations due to manufacturing, e.g., fuse radii can vary slightly from manufacturer to manufacturer. As demonstrated in FIGS. 2*d* and 6*c*, the arc length of jaw 104 is greater than that of jaw 108. In one embodiment, the respective arc lengths are equal. In another embodiment, the arc length of jaw 104 is less than that of jaw 108.

Jaw 108 is forked and includes a pair of tines 108*a* separated by slot 108*c* (see FIG. 1). Jaw 104 includes groove 104*a*, as demonstrated in FIG. 1*a*, FIG. 1*b*, and FIG. 2*b*, that extends along the length of jaw 104. When fuse 110 is retained between jaws 104 and 108, groove 104*a* receives a portion of central contact ring 110*a* and contact rings 110*b* straddle jaw 104, as shown in FIG. 6*d*. Moreover, tines 108*a* straddle central contact ring 110*a* and are respectively located between central contact ring 110*a* and one of contact rings 110*b*.

Each of bars 102 and 106 has several gripping elements 124 that are perpendicular to the longitudinal axes of bars 102 and 106 (see FIG. 1). It will be appreciated by those of ordinary skill in the art that any arrangement of gripping elements 124 that facilitates gripping tool 100 can be used, e.g., gripping elements 124 can have various profiles, such as triangular, truncated triangles, semi-circular, etc., gripping elements 124 can be oriented at an angle relative to the longitudinal axes of bars 102 and 106, or the like.

Figure 3A:
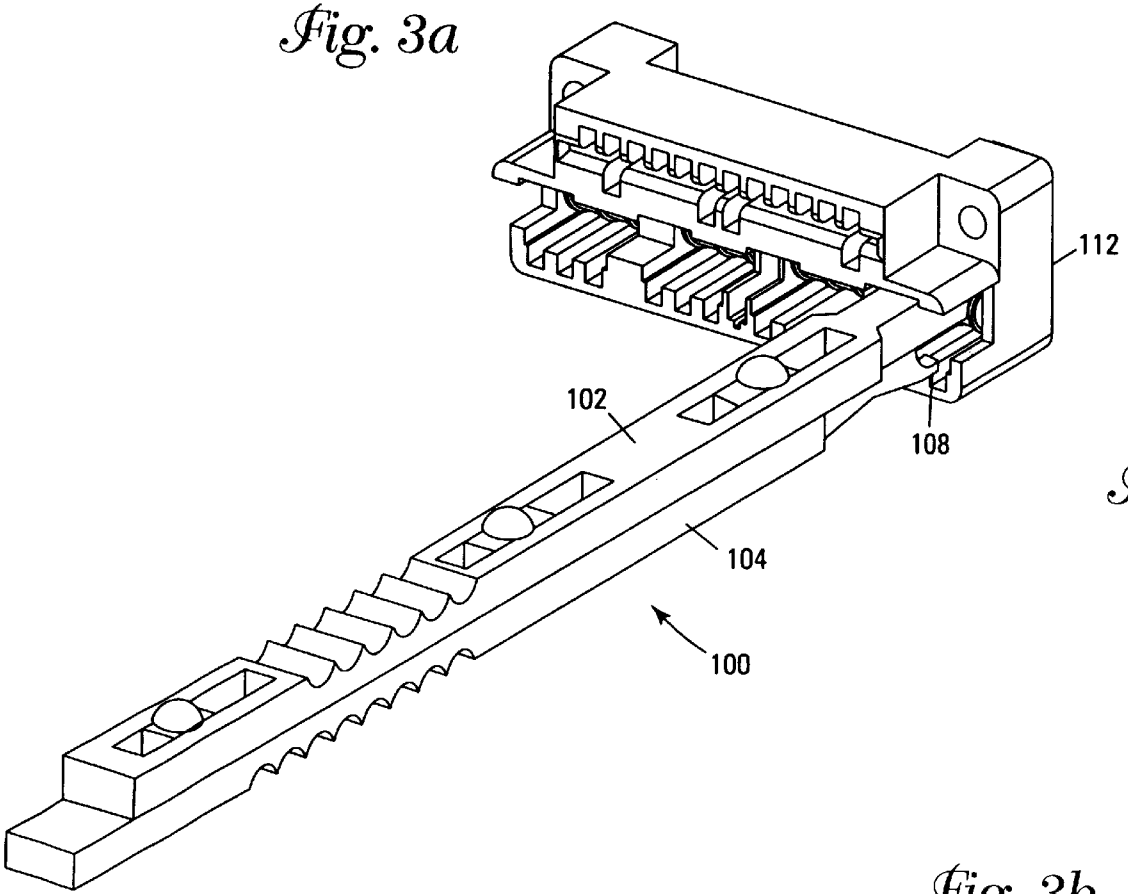
FIG. 3*a* is a top perspective-view of an embodiment of the present invention as inserted into a fuse protector-mount.
Figure 3C:
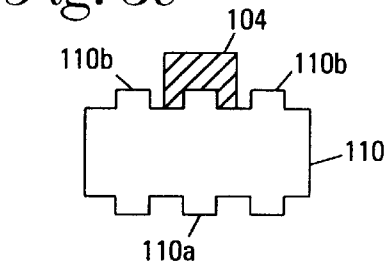
FIG. 3*c* is a cross-sectional view of a jaw engaging a fuse as viewed from the back of FIG. 3*a*.
Figure 3B:
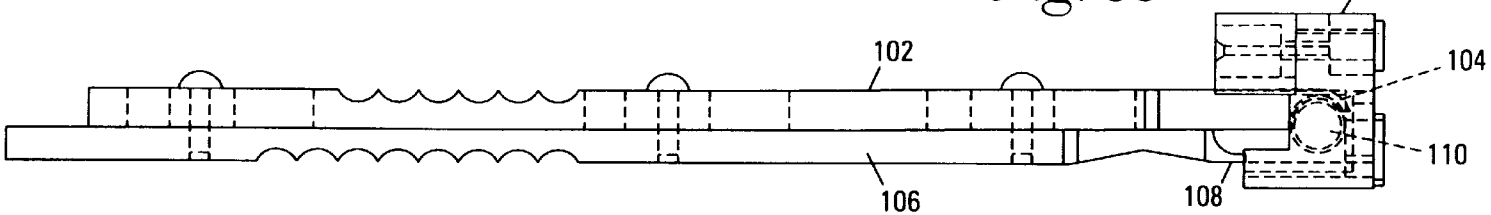
FIG. 3*b* is a side elevation view of an embodiment of the present invention as inserted into a fuse protector-mount.

To extract a fuse 110 from protector-mount 112, jaws 104 and 108 are actuated out of alignment, as shown in FIGS. 2*a*, 2*b*, and 2*d*, by sliding bars 102 and 106 relative to each other. Tool 100 is then inserted into protector-mount 112 so that the arc of jaw 104 engages a portion of the circumference of fuse 110, as shown in FIGS. 3*a* and 3*b*. In this position, groove 104*a* receives a portion of central contact ring 110*a* and contact rings 110*b* straddle jaw 104, as shown in FIG. 3*c*, a cross-sectional view of fuse 110 and jaw 104 as viewed from the back of FIG. 3*a*.

Figure 4:
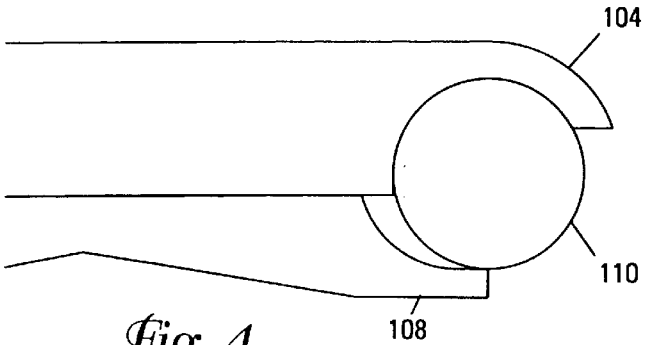
FIG. 4 is a side elevation view showing the jaws of an embodiment of the present invention being aligned to retain a fuse.
Figure 5B:
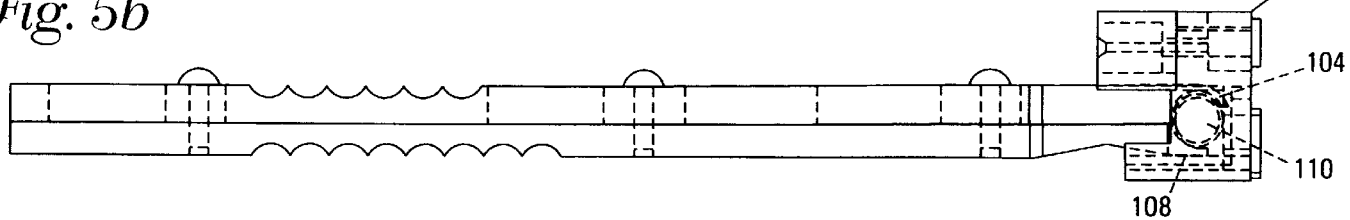
FIG. 5*b* is a side elevation view of an embodiment of the present invention as inserted into a fuse protector-mount and retaining a fuse.

Jaw 108 is then actuated into alignment with jaw 104 by sliding bar 106 relative to bar 102. As jaw 108 contacts fuse 110, as shown in FIG. 4, the resiliency of jaw 108 enables jaw 108 to be deflected by fuse 110. Continued actuation of jaw 108 slides jaw 108 over the surface of fuse 110 in the circumferential direction until fuse 110 is retained between jaws 104 and 108, as shown in FIGS. 5*a* and 5*b*. Note that when the jaws are aligned, as shown in FIGS. 5*a*, 5*b*, 6*a* and 6*b*, each protrusion 116 bears against end 118*a* of the corresponding slot 118, as shown in FIGS. 5*a* and 6*a*. Note further that when fuse 110 is retained between jaws 104 and 108, groove 104*a* receives a portion of central contact ring 110*a*, contact rings 110*b* straddle jaw 104, and tines 108*a* straddle central contact ring 110*a* and are respectively located between central contact ring 110*a* and one of contact rings 110*b*, as shown in FIG. 6*d*.

Figure 6C:
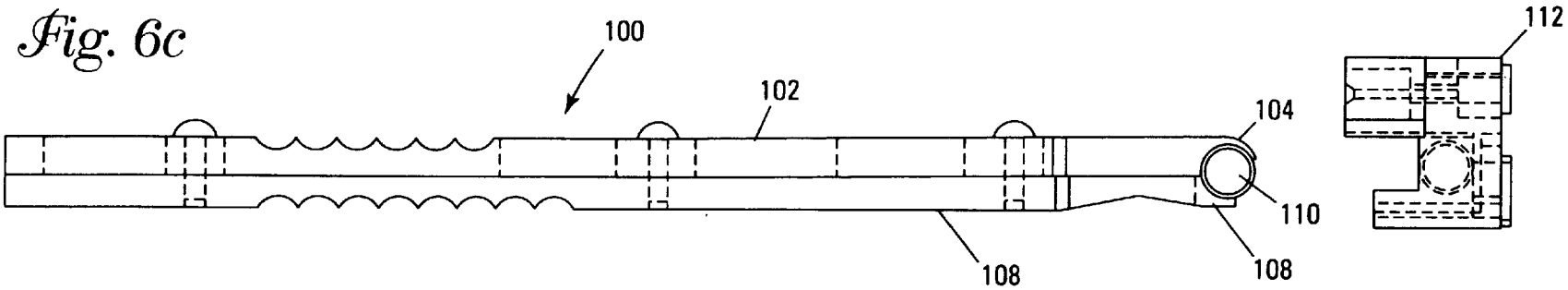
FIG. 6*c* is a side elevation view of an embodiment of the present invention after extracting a fuse from a fuse protector-mount and retaining the fuse.
Figure 6D:
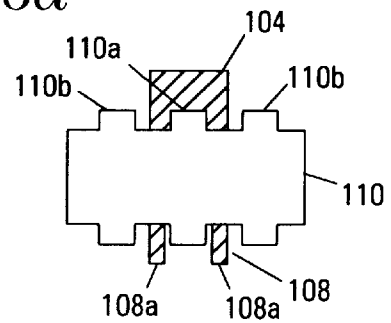
FIG. 6*d* is a cross-sectional view of the jaws of an embodiment of the present invention retaining a fuse as viewed from the right of FIG. 6*c*.
Figure 7:
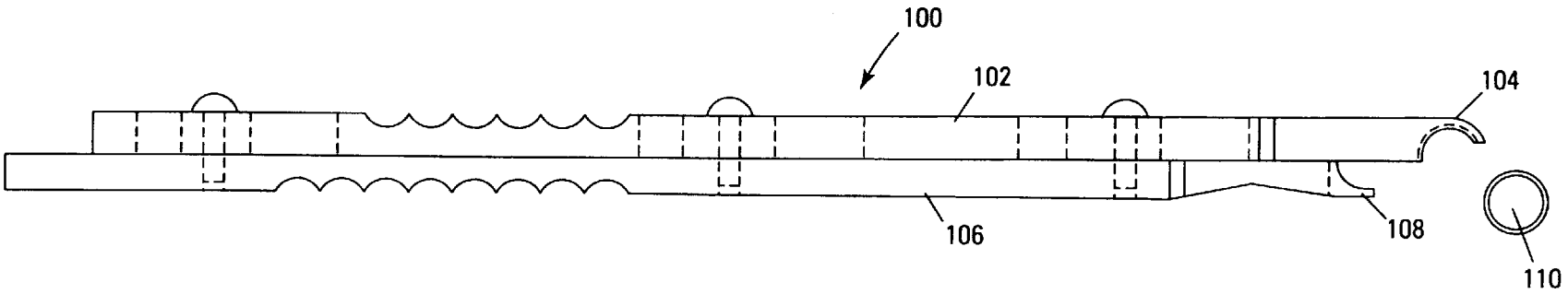
FIG. 7 is a side elevation view of an embodiment of the present invention releasing a fuse.

Fuse 110 is extracted from protector-mount 112, as shown in FIGS. 6*a*–6*c*, by applying a generally longitudinal force to tool 100 that is directed away from protector-mount 112. Fuse 110 is released from tool 100 by actuating jaws 104 and 108 out of alignment by sliding bars 102 and 106 relative to each other, as shown in FIG. 7. During the initial portion of the actuation, jaw 108 slides over the surface of fuse 110 in the circumferential direction and is deflected away from fuse 110. This is the reverse of that which occurs when the jaws are actuated into alignment, and the deflection of jaw 108 is similar to that demonstrated in FIG. 4.

Figure 8A:
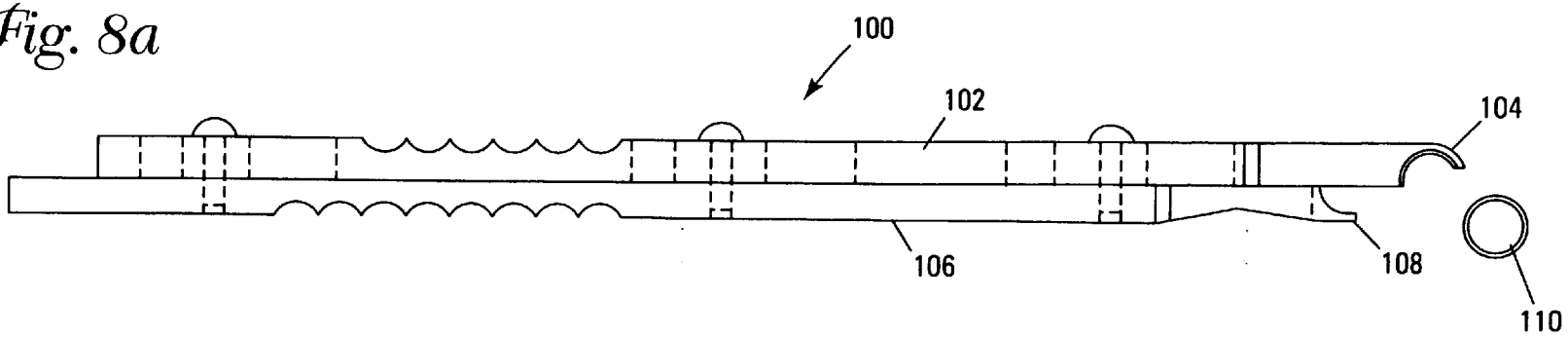
FIGS. 8*a* through 8*i* demonstrate an embodiment of a method of the present invention for installing a fuse in a fuse protector-mount.
Figure 8B:
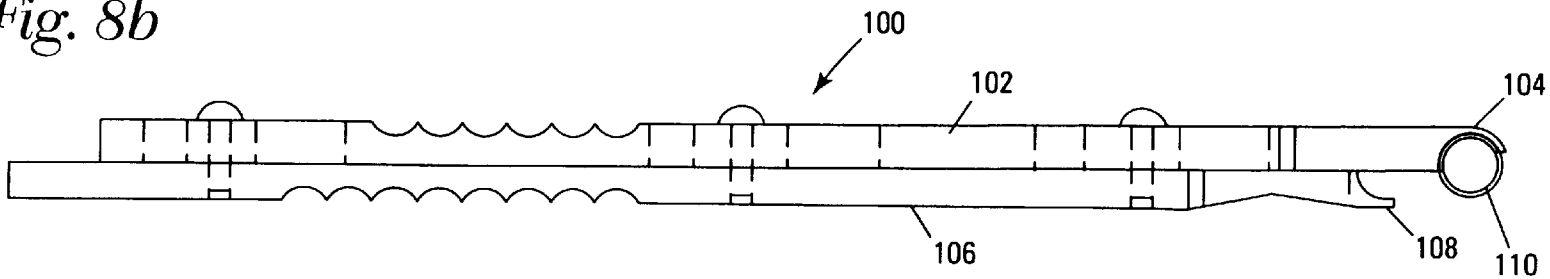
Figure 8C:
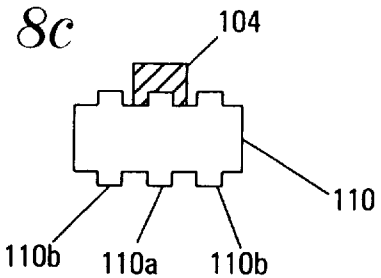

To install a fuse 110 in protector-mount 112, jaws 104 and 108 are actuated out of alignment, as shown in FIG. 8*a*, by sliding bars 102 and 106 relative to each other. Fuse 110 is positioned in jaw 104, as shown in FIG. 8*b*. In this position, groove 104*a* receives a portion of central contact ring 110*a* and contact rings 110*b* straddle jaw 104, as shown in FIG. 8*c*, a cross-sectional view of fuse 110 and jaw 104 as viewed from the right of FIG. 8*b*.

Figure 8F:
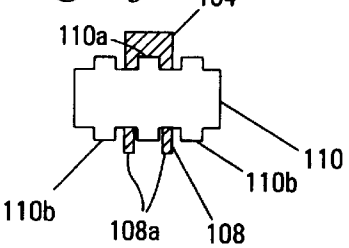
Figure 8D:
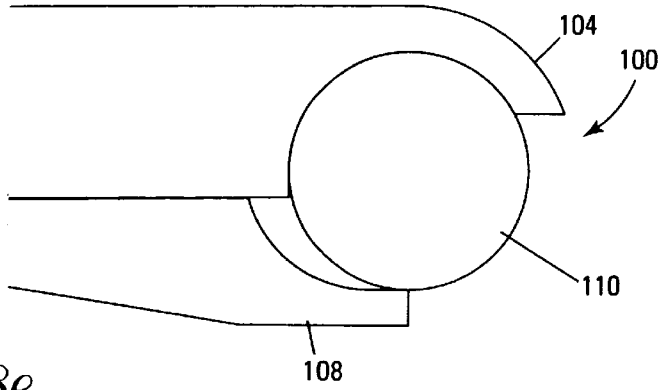
Figure 8E:
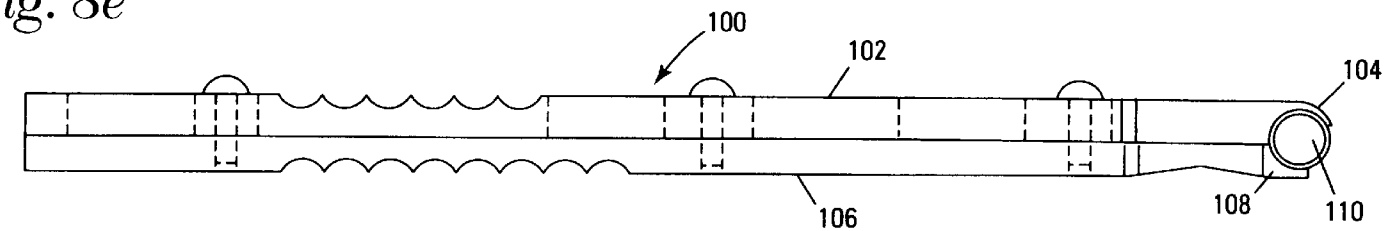

Jaws 104 and 108 are then actuated into alignment by sliding bars 102 and 106 relative to each other. As jaw 108 contacts fuse 110, as shown in FIG. 8*d*, the resiliency of jaw 108 enables jaw 108 to be deflected by fuse 110. Continued actuation slides jaw 108 over the surface of fuse 110 in the circumferential direction until fuse 110 is retained between jaws 104 and 108, as shown in FIG. 8*e* and FIG. 8*f*. FIG. 8*f* is a cross-sectional view of fuse 110 and jaws 104 and 108 as viewed from the right of FIG. 8*e*. FIG. 8*f* demonstrates that groove 104*a* receives a portion of central contact ring 110*a*, contact rings 110*b* straddle jaw 104, and tines 108*a* straddle central contact ring 110*a* and are respectively located between central contact ring 110*a* and one of contact rings 110*b*.

Figure 8G:
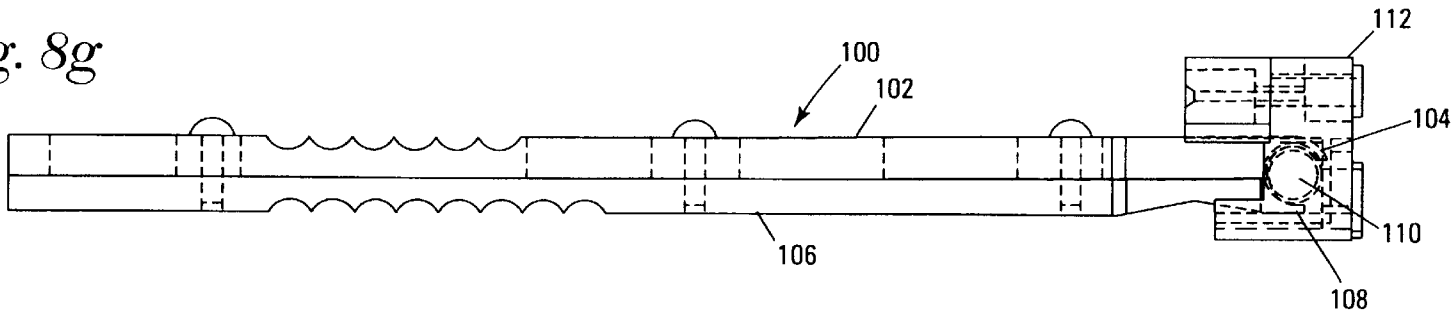
Figure 8H:
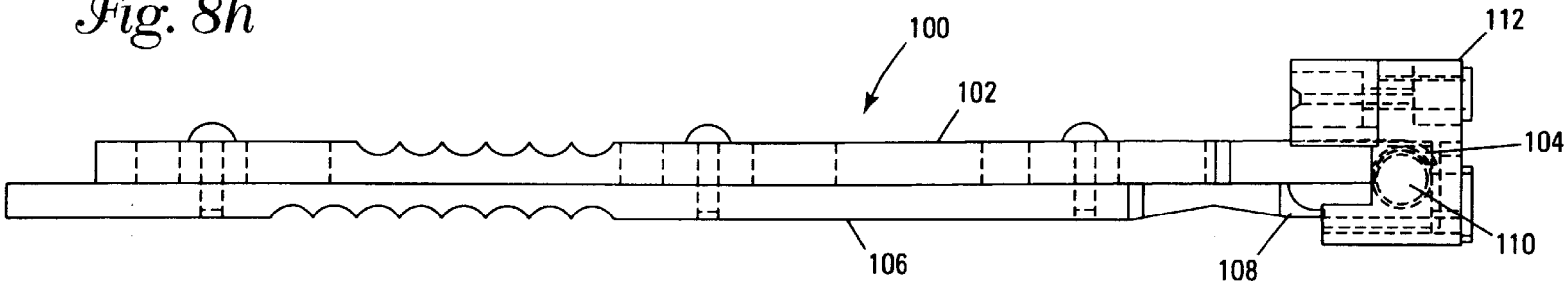
Figure 8I:
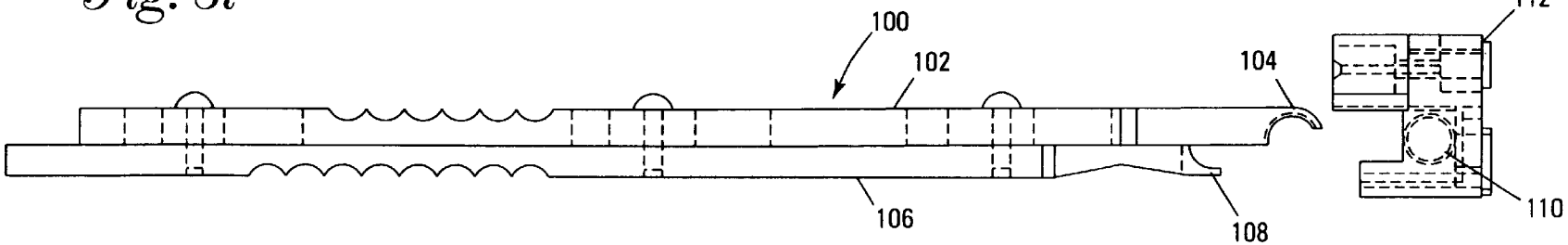

Fuse 110 is inserted into protector-mount 112, as shown in FIG. 8*g*, by applying a generally longitudinal force to tool 100 that is directed toward protector-mount 112. Tool 100 is released from fuse 110 by actuating jaws 104 and 108 out of alignment by sliding bar 106 relative to bar 104, as shown in FIG. 8*h*. During the initial portion of the actuation, jaw 108 slides over the surface of fuse 110 in the circumferential direction and is deflected away from fuse 110. This is the reverse of that which occurs when the jaws are actuated into alignment, and the deflection of jaw 108 is similar to that demonstrated in FIG. 8*d*. Tool 100 is then removed from protector-mount 112, as shown in FIG. 8*i*.

Figure 9:
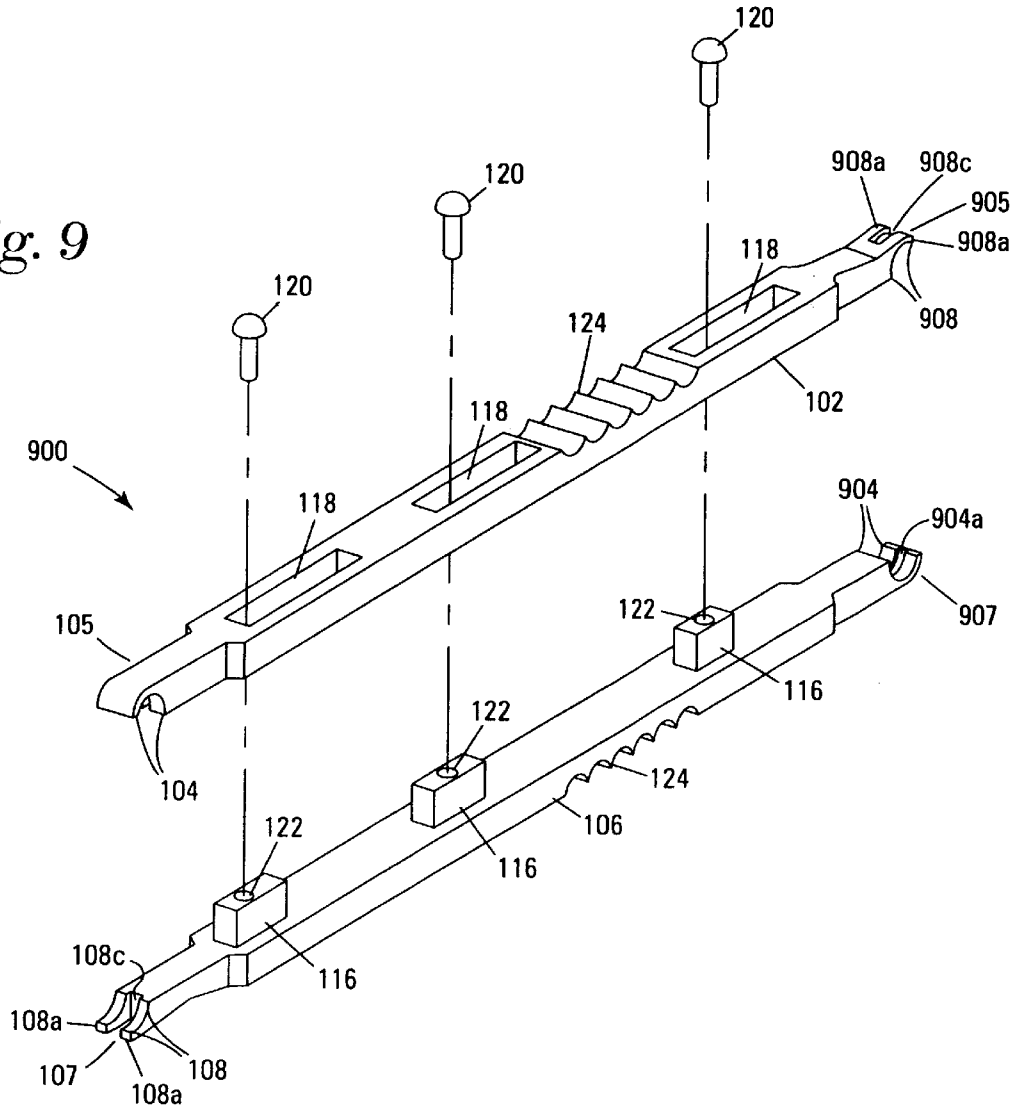
FIG. 9 is an exploded view of a second embodiment of the present invention.

A second embodiment of the present invention is exemplified by tool 900 in FIG. 9, an exploded view of tool 900. Elements in FIG. 9 that are common to both FIGS. 1 and 9 are numbered as in FIG. 1 and are as described above. FIG. 9 shows that bar 102 of tool 900 has jaw 908 at end 905 in addition to jaw 104 at end 105 and that bar 106 of tool 900 has jaw 904 at end 907 in addition to jaw 108 at end 107.

Jaw 908 is forked and includes a pair of tines 908*a* separated by slot 908*c*. Jaw 904 includes groove 904*a* that extends along the length of jaw 904. When fuse 110 is retained between jaws 904 and 908, groove 904*a* receives a portion of central contact ring 110*a* and contact rings 110*b* straddle jaw 904. Moreover, tines 908*a* straddle central contact ring 110*a* and are respectively located between central contact ring 110*a* and one of contact rings 110*b*.

In one embodiment, the radii of jaws 904 and 908 are different than the radii of jaws 104 and 108. This enables tool 900 to be used for fuses of two different diameters.

Figure 10A:
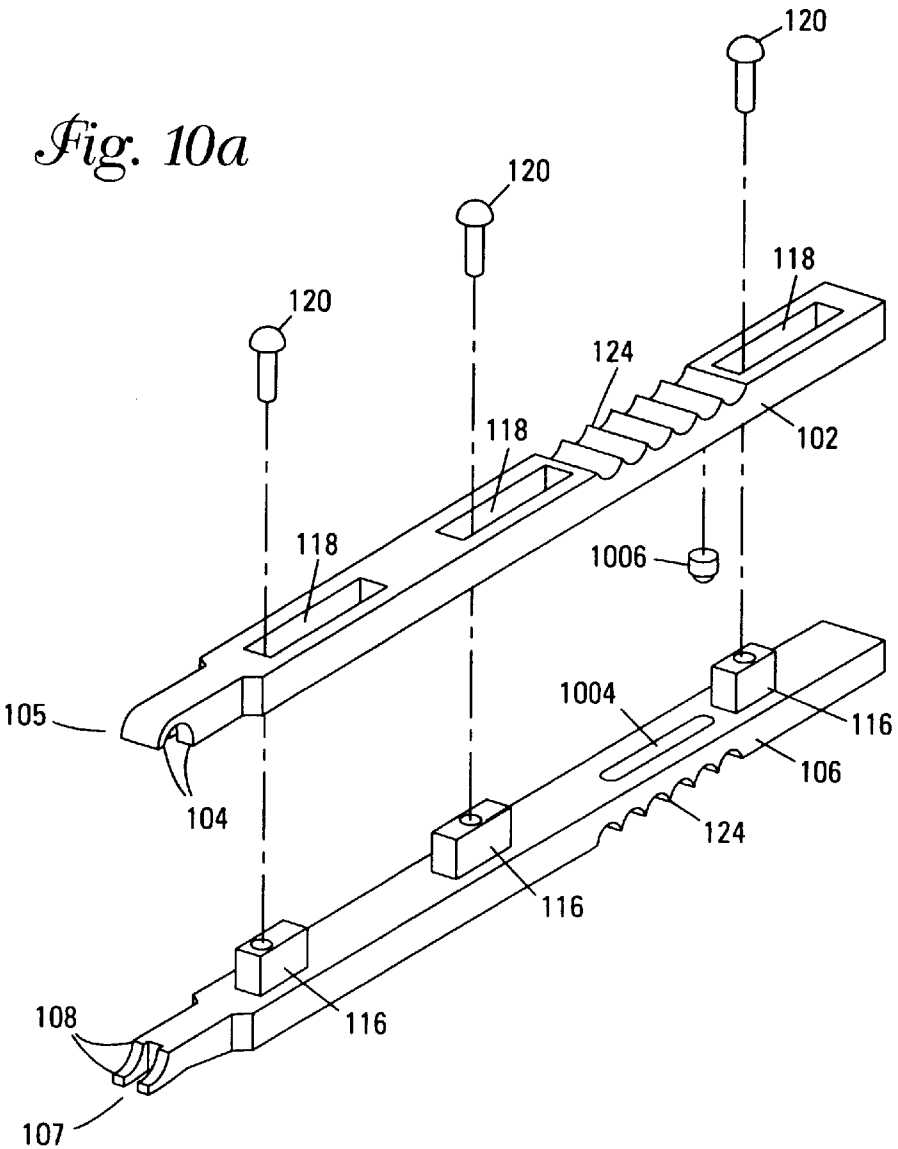
FIGS. 10*a* through 10*e* demonstrate a third embodiment of the present invention.
Figure 10B:
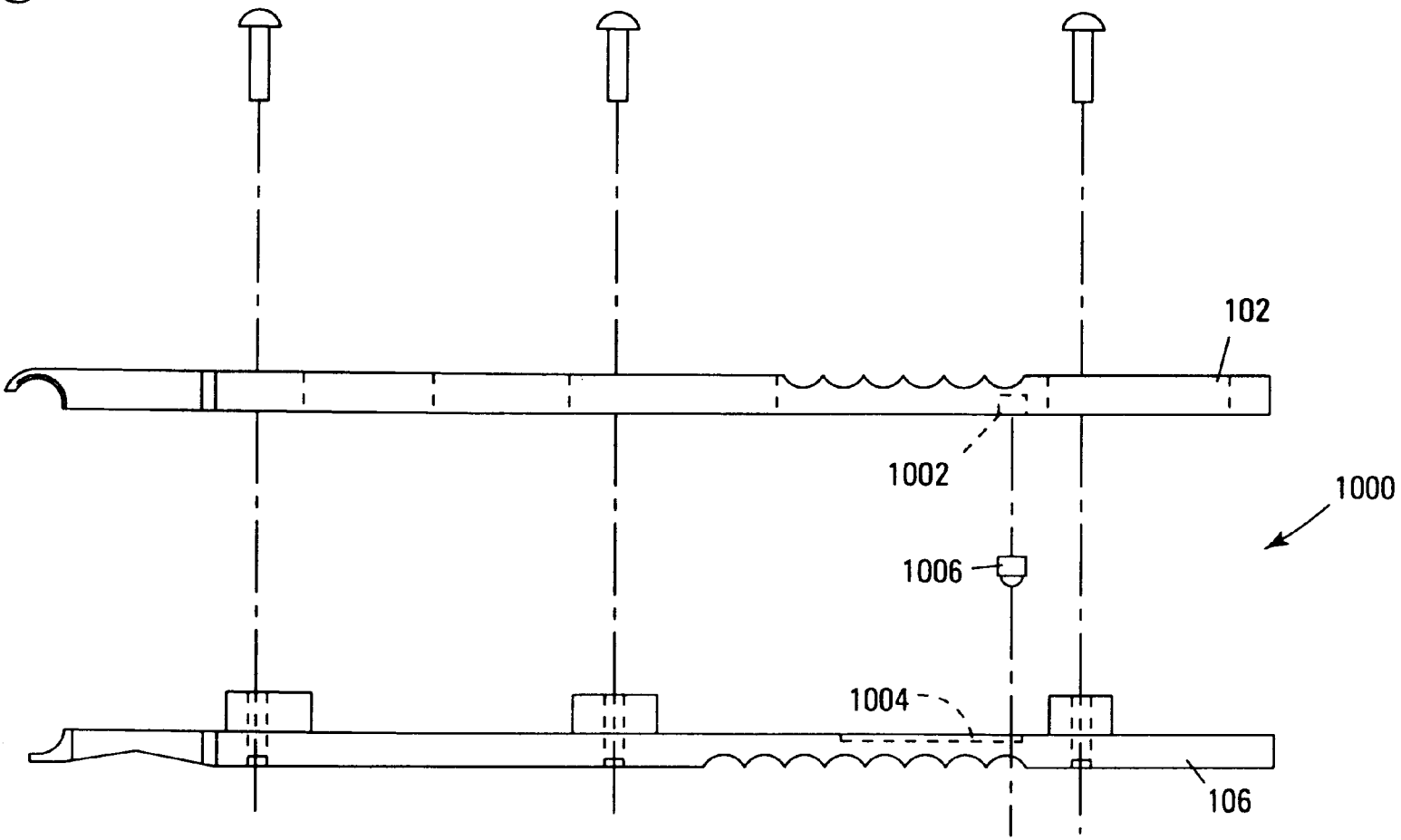

A third embodiment of the present invention is exemplified by tool 1000 in FIGS. 10*a* and 10*b*. Elements in FIGS. 10*a* and 10*b* that are common to FIG. 1 and FIGS. 10*a* and 10*b* are numbered as in FIG. 1 and are as described above. FIG. 10*b* shows that bar 102 of tool 1000 includes blind hole 1002, and FIGS. 10*a* and 10*b* show that bar 106 of tool 1000 includes slot 1004. In another embodiment, bar 102 includes slot 1004, and bar 106 includes blind hole 1002.

Figure 10C:
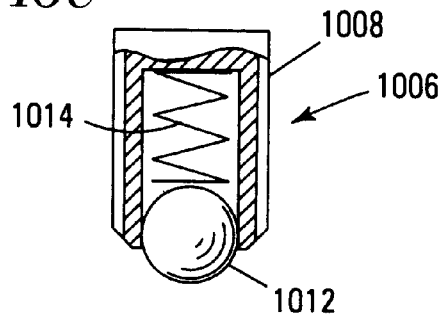

Tool 1000 also includes ball plunger 1006, as shown in FIGS. 10*a*—10*e* and available from M. J. Vail Company, Inc. and Jergens, Inc. Ball plunger 1006 includes housing 1008 containing ball 1012 that is biased by spring 1014 so that ball 1012 protrudes from housing 1008, as shown in FIG. 10*c*. Housing 1008 is secured in blind hole 1002 by pressing, threading, gluing, or the like. Ball 1012 rides in slot 1004 when bars 102 and 106 slide relative to each other.

Figure 10D:
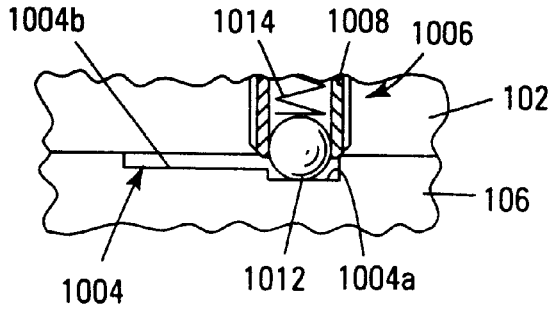
Figure 10E:
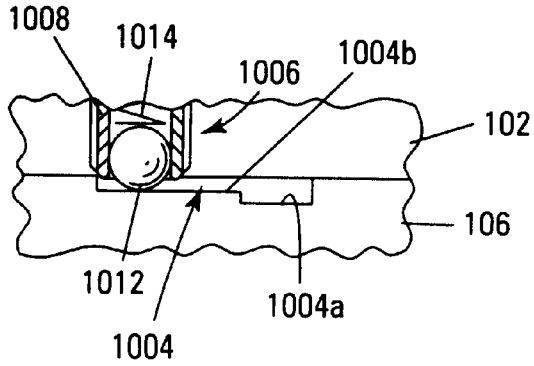

FIGS. 10*d* and 10*e* are enlarged views respectively showing the position of ball 1012 when jaws 104 and 108 are aligned and are out of alignment. FIGS. 10*d* and 10*e* also show that slot 1004 includes recess 1004*a* and elevated portion 1004*b*. When jaws 104 and 108 are aligned, ball 1012 extends into recess 1004*a* of slot 1004 and locks jaws 104 and 108 in the aligned position, as shown in FIG. 10*d*. When jaws 104 and 108 are out of alignment, elevated portion 1004*b* of slot 1004 pushes ball 1012 into housing 1008, compressing spring 1014, as shown in FIG. 10*e*.

Figure 11A:
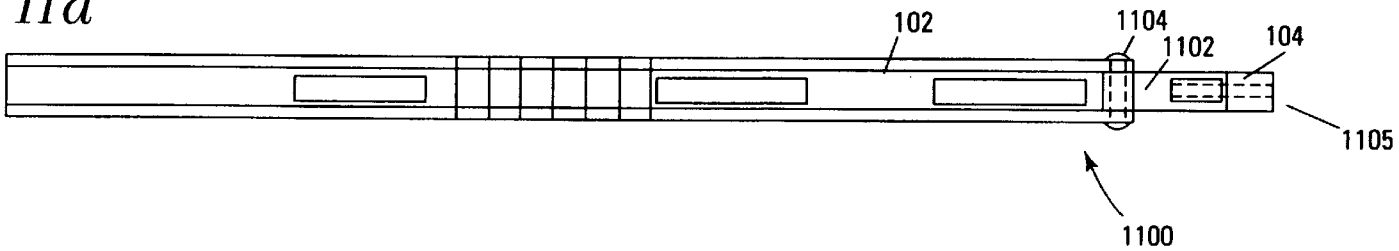
FIGS. 11*a* through 11*d* demonstrate a fourth embodiment of the present invention.
Figure 11B:
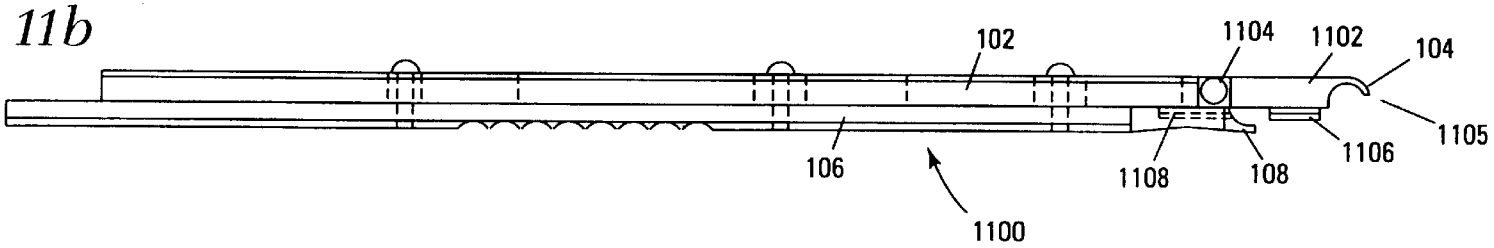
Figure 11C:
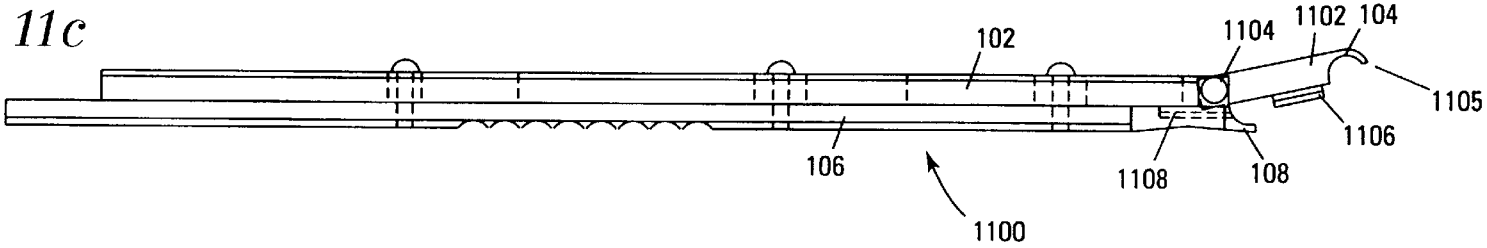

A fourth embodiment of the present invention is exemplified by tool 1100 in FIGS. 11*a*—11*c*. FIG. 11*a* is atop view of tool 1100, and FIGS. 11*b* and 11*c* are side views, where FIG. 11*c* illustrates a feature for pivoting jaw 104. Elements in FIGS. 11*a*—11*c* that are common to both FIG. 1 and FIGS. 11*a*—11*c* are numbered as in FIG. 1 and are as described above. Bar 102 of tool 1100 includes head 1102 that is pivotally attached to bar 102 by pin 1104. Pin 1104 is perpendicular to the longitudinal axis of bar 102, as shown in FIG. 11*a*. Jaw 104 is located at end 1105 of head 1102. Head 1102 pivots jaw 104 about pin 1104 when jaws 102 and 108 are out of alignment, as shown in FIG. 11*c*.

Figure 11D:
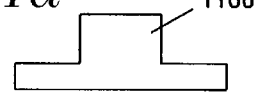

Head 1102 includes protrusion 1106. Protrusion 1106 has a T-shaped cross-section, as shown in FIG. 11*d*, a cross-sectional view of protrusion 1106 as viewed from end 1105 of bar 102. In another embodiment, protrusion 1106 has an L-shaped cross-section. Bar 106 includes slot 1108 that extends longitudinally from jaw 108, as shown in FIGS. 11*b* and 11*c*. In this embodiment, slot 1108 is a T-slot. In another embodiment, slot 1108 is an L-slot.

To bring jaws 104 and 108 into alignment from the non-aligned pivoted position shown in FIG. 11*c*, head 1102 is pivoted into the position shown in FIG. 11*b*. Then bars 102 and 106 are slid relative to each other to align jaws 104 and 108. As 102 and 106 are slid relative to each other, protrusion 1106 is received by slot 1108 to prevent jaw 104 from pivoting while the jaws 104 and 108 are aligned.

Pivoting of jaw 104 enables tool 1100 to be used in tighter spaces than fuse tools without the pivoting provision. For example, when extracting a fuse 110 from a protector-mount 112, jaws 104 and 108 are actuated out of alignment by sliding bars 102 and 106 relative to each other into the position shown in FIG. 11*b*. Jaw 104 is then pivoted away from bar 106 to the position shown in FIG. 11*c*. Jaw 104 is pivoted toward bar 106 to the position shown in FIG. 11*b* prior to aligning jaws 104 and 108 to retain a fuse 110 therebetween. After inserting a fuse 110 into a protector-mount 112, tool 1100 is released from fuse 110 by actuating jaws 104 and 108 out of alignment by sliding bars 102 and 106 relative to each other into the position shown in FIG. 11*b*. Jaw 104 is then pivoted away from bar 106 to the position shown in FIG. 11*c*.

CONCLUSION

Embodiments of the present invention have been described. The embodiments provide tools for installing and extracting fuses that reduce the user's risk for electrical shocks, reduce the risk of electrical shorts, can be operated with one hand, and do not require the user to apply a continuous force to the tools to maintain engagement between the tools and the fuses.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, the jaws can be modified to accommodate different types of fuses so that the tool is not limited to fuses of the type of fuse 110. Specifically, the groove in jaw 104 can be removed or additional grooves can be added, or jaw 104 can be forked and have two or more tines. Moreover, jaw 108 can have more than two tines, or the tines replaced by a continuous jaw.

What is claimed is:

1. A tool for installing and extracting a fuse, the tool comprising:

a first bar having a jaw at a first end of the first bar; and a second bar slidably attached to the first bar and having a jaw at a first end of the second bar, wherein the jaw of the second bar is forked and further wherein the respective jaws are adapted to align by sliding the respective bars relative to each other to retain the fuse between the jaws.

2. The tool of claim 1, wherein the jaw of the first bar and the jaw of the second bar have arced profiles of substantially the same radii that are substantially equal to the radius of a fuse.

3. The tool of claim 2, wherein the arc length of the jaw of the first bar is one of greater than, less than, and equal to the arc length of the jaw of the second bar.

4. The tool of claim 1, wherein the jaw of the first bar includes a groove.

5. The tool of claim 1, wherein the jaw of the first bar and the jaw of the second bar are resilient.

6. The tool of claim 1, further comprising a jaw at a second end of the first bar and a jaw at a second end of the second bar.

7. The tool of claim 6, wherein the arc length of the jaw at the second end of the second bar is one of greater than, less than, and equal to the arc length of the jaw at the second end of the first bar.

8. The tool of claim 6, wherein the jaw at the second end of the first bar is forked.

9. The tool of claim 6, wherein the jaw at the second end of the second bar includes a groove.

10. The tool of claim 6, wherein the jaw at the second end of the first bar and the jaw at the second end of the second bar are resilient.

11. The tool of claim 1, wherein the jaw of the first bar pivots about an axis that is perpendicular to the longitudinal axis of the first bar.

12. The tool of claim 1, further comprising a ball that rides between the first and second bars when respective bars slide relative to each other.

13. The tool of claim 12, wherein the ball rides a slot in one of the first and second bars when respective bars slide relative to each other.

14. The tool of claim 13, wherein the ball extends into a recess in the slot when the respective jaws are aligned, thereby locking the respective jaws in the aligned position.

15. A tool for installing and extracting a fuse, the tool comprising:

a first bar having a jaw at a first end of the first bar, the jaw having an arced profile; and a second bar slidably attached to the first bar and having a jaw at a first end of the second bar, the jaw having an arced profile, wherein the respective jaws are adapted to align by sliding the respective bars relative to each other such that the aligned jaws form a substantially continuous arc for bearing against the fuse to retain the fuse and further wherein the jaw of the second bar is forked and includes a pair of parallel tines each having an arced profile.

16. The tool of claim 15, wherein the radii of the arced profiles of the jaw of the first bar and the jaw of the second bar are substantially equal to the radius of a fuse and the arc length of the jaw of the first bar is one of greater than, less than, and equal to the arc length of the jaw of the second bar.

17. The tool of claim 15, wherein the jaw of the first bar includes a groove along the length of the jaw.

18. The tool of claim 15, wherein the jaw of the first bar and the jaw of the second bar are resilient.

19. The tool of claim 15, further comprising a jaw at a second end of the first bar and a jaw at a second end of the second bar.

20. The tool of claim 19, wherein the radii of the arced profiles of the jaw at the second end of the first bar and the jaw at the second end of the second bar are substantially equal to the radius of a fuse and the arc length of the jaw at the second end of the second bar is one of greater than, less than, and equal to the arc length of the jaw at the second end of the first bar.

21. The tool of claim 19, wherein the jaw at the second end of the first bar is forked and includes a pair of parallel tines each having an arced profile.

22. The tool of claim 19, wherein the jaw at the second end of the second bar includes a groove.

23. The tool of claim 19, wherein the jaw at the second end of the first bar and the jaw at the second end of the second bar are resilient.

24. The tool of claim 15, wherein the jaw of the first bar pivots about an axis that is perpendicular to the longitudinal axis of the first bar.

25. The tool of claim 15, further comprising a ball that rides between the first and second bars when respective bars slide relative to each other.

26. The tool of claim 25, wherein the ball rides a slot in one of the first and second bars when respective bars slide relative to each other.

27. The tool of claim 26, wherein the ball extends into a recess in the slot when the respective jaws are aligned, thereby locking the respective jaws in the aligned position.

28. A tool for installing and extracting a fuse, the tool comprising:

a first bar having a resilient jaw at a first end of the first bar, the jaw having an arced profile and a groove along the length of the jaw; and a second bar slidably attached to the first bar and having a forked resilient jaw at a first end of the second bar that includes a pair of parallel tines each having an arced profile;

wherein the respective jaws are adapted to align by sliding the respective bars relative to each other such that the aligned jaws form a substantially continuous arc for bearing against the fuse to retain the fuse; and wherein the groove of the jaw of the first bar is adapted to receive a portion of a central contact ring that encircles and protrudes from the fuse and the tines of the jaw of the second bar are adapted to straddle the central contact ring.

29. The tool of claim 28, further comprising:

a resilient jaw at a second end of the second bar, the jaw at the second end of the first bar having an arced profile and a groove along the length of the jaw at the second end of the second bar; and a forked resilient jaw at a second end of the first bar that includes a pair of parallel tines each having an arced profile.

30. The tool of claim 28, wherein the jaw of the first bar pivots about an axis that is perpendicular to the longitudinal axis of the first bar.

31. The tool of claim 28, further comprising a ball that rides between the first and second bars when respective bars slide relative to each other.

32. The tool of claim 31, wherein the ball rides a slot in one of the first and second bars when respective bars slide relative to each other.

33. The tool of claim 32, wherein the ball extends into a recess in the slot when the respective jaws are aligned, thereby locking the respective jaws in the aligned position.

34. A method for extracting a fuse from a fuse protector-mount, the method comprising:

inserting a fuse tool into the protector-mount so that a jaw that is located at an end of a first bar of the fuse tool engages a portion of the fuse;

retaining the fuse between the jaw of the first bar and a jaw located at an end of a second bar that is slidably attached to the first bar by actuating the respective jaws into alignment by sliding the respective bars relative to each other wherein the jaw of the first bar and the jaw of the second bar are resilient; and extracting the fuse from the protector-mount using the tool.

35. The method of claim 34, further comprising actuating the respective jaws out of alignment before inserting the fuse tool into the protector-mount by sliding the respective bars relative to each other.

36. The method of claim 35, further comprising pivoting the jaw of the first bar after actuating the respective jaws out of alignment so that the jaw of the first bar moves away from the second bar, wherein the jaw of the first bar pivots about an axis that is perpendicular to the longitudinal axis of the first bar.

37. The method of claim 36, wherein retaining the fuse includes pivoting the jaw of the first bar before actuating the respective jaws into alignment so that the jaw of the first bar moves toward the second bar.

38. The method of claim 34, wherein inserting a fuse tool into the protector-mount includes the jaw of the first bar having an arced profile that engages a portion of the fuse along the length of the jaw.

39. The method of claim 38, wherein retaining the fuse includes the jaw of the second bar having an arced profile so that when the respective jaws are actuated into alignment, the aligned jaws form a substantially continuous arc for bearing against the fuse.

40. The method of claim 39, wherein retaining the fuse includes the jaw of the first bar having a groove along the length of the jaw and the jaw of the second bar having a pair of parallel tines, wherein the groove of the jaw of the first bar receives a portion of a central contact ring that encircles and protrudes from the fuse and the tines of the jaw of the second bar straddle the central contact ring.

41. The method of claim 34, wherein retaining the fuse includes a ball riding between the first and second bars as the respective bars slide relative to each other.

42. The method of claim 41, wherein retaining the fuse includes the ball riding in a slot in one of the first and second bars.

43. The method of claim 42, wherein retaining the fuse includes locking the respective jaws in the aligned position, wherein locking the respective jaws in the aligned position is accomplished by the ball extending into a recess in the slot.

44. The method of claim 34, further comprising releasing the fuse from the tool after extracting it by actuating the respective jaws out of alignment by sliding the respective bars relative to each other.

45. The method of claim 34, wherein extracting the fuse includes applying a force to the tool that is directed away from the protector-mount.

46. A method for extracting a fuse from a fuse protector-mount, the method comprising:

inserting a fuse tool into the protector-mount so that a jaw having an arced profile and a groove that is located at an end of a first bar of the fuse tool engages a portion of the fuse along the length of the jaw, wherein the groove of the jaw receives a portion of a central contact ring that encircles and protrudes from the fuse;

retaining the fuse between the jaw of the first bar and a forked jaw located at an end of a second bar that is slidably attached to the first bar and having a pair of arced parallel tines by actuating the respective jaws into alignment by sliding the respective bars relative to each other such that the aligned jaws form a substantially continuous arc for bearing against the fuse to retain it, wherein the tines of the jaw of the second bar straddle the central contact ring; and extracting the fuse from the protector-mount using the tool.

47. The method of claim 46, further comprising actuating the respective jaws out of alignment before inserting the fuse tool into the protector-mount by sliding the respective bars relative to each other.

48. The method of claim 47, further comprising pivoting the jaw of the first bar after actuating the respective jaws out of alignment so that the jaw of the first bar moves away from the second bar, wherein the jaw of the first bar pivots about an axis that is perpendicular to the longitudinal axis of the first bar.

49. The method of claim 48, wherein retaining the fuse includes pivoting the jaw of the first bar before actuating the respective jaws into alignment so that the jaw of the first bar moves toward the second bar.

50. The method of claim 46, further comprising releasing the fuse from the tool after extracting it by actuating the respective jaws out of alignment by sliding the respective bars relative to each other.

51. The method of claim 46, wherein retaining the fuse includes a ball riding between the first and second bars as the respective bars slide relative to each other.

52. The method of claim 51, wherein retaining the fuse includes the ball riding in a slot in one of the first and second bars.

53. The method of claim 52, wherein retaining the fuse includes locking the respective jaws in the aligned position, wherein locking the respective jaws in the aligned position is accomplished by the ball extending into a recess in the slot.

54. The method of claim 46, wherein extracting the fuse includes applying a force to the tool that is directed away from the protector-mount.

55. A method for installing a fuse in a fuse protector-mount, the method comprising:

positioning the fuse in a jaw located at an end of a first bar of a fuse tool;

retaining the fuse between the jaw of the first bar and a jaw located at an end of a second bar that is slidably attached to the first bar by actuating the respective jaws into alignment by sliding the respective bars relative to each other wherein the jaw of the first bar and the jaw of the second bar are resilient; and inserting the fuse into the protector mount using the tool.

56. The method of claim 55, further comprising actuating the respective jaws out of alignment by sliding the respective bars relative to each other before positioning the fuse in the jaw located at an end of the first bar.

57. The method of claim 55, wherein retaining the fuse includes a ball riding between the first and second bars as the respective bars slide relative to each other.

58. The method of claim 57, wherein retaining the fuse includes the ball riding in a slot in one of the first and second bars.

59. The method of claim 58, wherein retaining the fuse includes locking the respective jaws in the aligned position, wherein locking the respective jaws in the aligned position is accomplished by the ball extending into a recess in the slot.

60. The method of claim 55, wherein positioning the fuse in a jaw located at an end of a first bar includes the jaw having an arced profile that engages a portion of the fuse along the length of the jaw.

61. The method of claim 60, wherein retaining the fuse includes the jaw of the second bar having an arced profile so that when the respective jaws are actuated into alignment, the aligned jaws form a substantially continuous arc for bearing against the fuse.

62. The method of claim 61, wherein retaining the fuse includes the jaw of the first bar having a groove along the length of the jaw and the jaw of the second bar having a pair of parallel tines, wherein the groove of the jaw of the first bar receives a portion of a central contact ring that encircles and protrudes from the fuse and the tines of the jaw of the second bar straddle the central contact ring.

63. The method of claim 55, wherein inserting the fuse includes applying a force to the tool in the direction of the protector-mount.

64. The method of claim 55, further comprising releasing the fuse from the tool after inserting it by actuating the respective jaws out of alignment by sliding the respective bars relative to each other.

65. The method of claim 64, further comprising pivoting the jaw of the first bar after actuating the respective jaws out of alignment so that the jaw of the first bar moves away from the second bar, wherein the jaw of the first bar pivots about an axis that is perpendicular to the longitudinal axis of the first bar.

66. The method of claim 64, further comprising removing the tool from the protector-mount after releasing the fuse.

67. A method for installing a fuse in a fuse protector-mount, the method comprising:

positioning the fuse in a jaw having an arced profile and a groove that is located at an end of a first bar of a fuse tool so that the jaw engages a portion of the fuse along the length of the jaw and the groove of the jaw receives a portion of a central contact ring that encircles and protrudes from the fuse;

retaining the fuse between the jaw of the first bar and a forked jaw located at an end of a second bar that is slidably attached to the first bar and having a pair of arced parallel tines by actuating the respective jaws into alignment by sliding the respective bars relative to each other such that the aligned jaws form a substantially continuous arc for bearing against the fuse to retain the fuse, wherein the tines of the jaw of the second bar straddle the central contact ring; and inserting the fuse into the protector mount.

68. The method of claim 67, further comprising actuating the respective jaws out of alignment by sliding the respective bars relative to each other before positioning the fuse in the jaw located at an end of the first bar.

69. The method of claim 67, wherein retaining the fuse includes a ball riding between the first and second bars as the respective bars slide relative to each other.

70. The method of claim 69, wherein retaining the fuse includes the ball riding in a slot in one of the first and second bars.

71. The method of claim 70, wherein retaining the fuse includes locking the respective jaws in the aligned position, wherein locking the respective jaws in the aligned position is accomplished by the ball extending into a recess in the slot.

72. The method of claim 67, wherein inserting the fuse includes applying a force to the tool in the direction of the protector-mount.

73. The method of claim 67, further comprising releasing the fuse from the tool after inserting it by actuating the respective jaws out of alignment by sliding the respective bars relative to each other.

74. The method of claim 73, further comprising pivoting the jaw of the first bar after actuating the respective jaws out of alignment so that the jaw of the first bar moves away from the second bar, wherein the jaw of the first bar pivots about an axis that is perpendicular to the longitudinal axis of the first bar.

75. The method of claim 73, further comprising removing the tool from the protector-mount after releasing the fuse.

76. A tool for installing and extracting a fuse, the tool comprising:

a first bar having a jaw at a first end of the first bar wherein the jaw of the first bar includes a groove; and a second bar slidably attached to the first bar and having a jaw at a first end of the second bar, wherein the respective jaws are adapted to align by sliding the respective bars relative to each other to retain the fuse between the jaws.

77. The tool of claim 76, wherein the jaw of the first bar and the jaw of the second bar have arced profiles of substantially the same radii that are substantially equal to the radius of a fuse.

78. The tool of claim 77, wherein the arc length of the jaw of the first bar is one of greater than, less than, and equal to the arc length of the jaw of the second bar.

79. The tool of claim 76, wherein the jaw of the first bar and the jaw of the second bar are resilient.

80. The tool of claim 76, further comprising a jaw at a second end of the first bar and a jaw at a second end of the second bar.

81. The tool of claim 80, wherein the arc length of the jaw at the second end of the second bar is one of greater than, less than, and equal to the arc length of the jaw at the second end of the first bar.

82. The tool of claim 80, wherein the jaw at the second end of the first bar is forked.

83. The tool of claim 80, wherein the jaw at the second end of the second bar includes a groove.

84. The tool of claim 80, wherein the jaw at the second end of the first bar and the jaw at the second end of the second bar are resilient.

85. The tool of claim 76, wherein the jaw of the first bar pivots about an axis that is perpendicular to the longitudinal axis of the first bar.

86. The tool of claim 76, further comprising a ball that rides between the first and second bars when respective bars slide relative to each other.

87. The tool of claim 86, wherein the ball rides a slot in one of the first and second bars when respective bars slide relative to each other.

88. The tool of claim 87, wherein the ball extends into a recess in the slot when the respective jaws are aligned, thereby locking the respective jaws in the aligned position.

89. A tool for installing and extracting a fuse, the tool comprising:

a first bar having a jaw at a first end of the first bar; and a second bar slidably attached to the first bar and having a jaw at a first end of the second bar, wherein the respective jaws are adapted to align by sliding the respective bars relative to each other to retain the fuse between the jaws and further wherein the jaw of the first bar and the jaw of the second bar are resilient.

90. The tool of claim 89, wherein the jaw of the first bar and the jaw of the second bar have arced profiles of substantially the same radii that are substantially equal to the radius of a fuse.

91. The tool of claim 90, wherein the arc length of the jaw of the first bar is one of greater than, less than, and equal to the arc length of the jaw of the second bar.

92. The tool of claim 89, further comprising a jaw at a second end of the first bar and a jaw at a second end of the second bar.

93. The tool of claim 92, wherein the arc length of the jaw at the second end of the second bar is one of greater than, less than, and equal to the arc length of the jaw at the second end of the first bar.

94. The tool of claim 92, wherein the jaw at the second end of the first bar is forked.

95. The tool of claim 92, wherein the jaw at the second end of the second bar includes a groove.

96. The tool of claim 92, wherein the jaw at the second end of the first bar and the jaw at the second end of the second bar are resilient.

97. The tool of claim 89, wherein the jaw of the first bar pivots about an axis that is perpendicular to the longitudinal axis of the first bar.

98. The tool of claim 89, further comprising a ball that rides between the first and second bars when respective bars slide relative to each other.

99. The tool of claim 98, wherein the ball rides a slot in one of the first and second bars when respective bars slide relative to each other.

100. The tool of claim 99, wherein the ball extends into a recess in the slot when the respective jaws are aligned, thereby locking the respective jaws in the aligned position.

101. A tool for installing and extracting a fuse, the tool comprising:

a first bar having a jaw at a first end of the first bar;

a second bar slidably attached to the first bar and having a jaw at a first end of the second bar, wherein the respective jaws are adapted to align by sliding the respective bars relative to each other to retain the fuse between the jaws; and a jaw at a a second end of the first bar and a jaw at a second end of the second bar wherein the jaw at the second end of the first bar is forked.

102. The tool of claim 101, wherein the jaw of the first bar and the jaw of the second bar have arced profiles of substantially the same radii that are substantially equal to the radius of a fuse.

103. The tool of claim 102, wherein the arc length of the jaw of the first bar is one of greater than, less than, and equal to the arc length of the jaw of the second bar.

104. The tool of claim 101, wherein the arc length of the jaw at the second end of the second bar is one of greater than, less than, and equal to the arc length of the jaw at the second end of the first bar.

105. The tool of claim 101, wherein the jaw at the second end of the second bar includes a groove.

106. The tool of claim 101, wherein the jaw at the second end of the first bar and the jaw at the second end of the second bar are resilient.

107. The tool of claim 101, wherein the jaw of the first bar pivots about an axis that is perpendicular to the longitudinal axis of the first bar.

108. The tool of claim 101, further comprising a ball that rides between the first and second bars when respective bars slide relative to each other.

109. The tool of claim 108, wherein the ball rides a slot in one of the first and second bars when respective bars slide relative to each other.

110. The tool of claim 109, wherein the ball extends into a recess in the slot when the respective jaws are aligned, thereby locking the respective jaws in the aligned position.

111. A tool for installing and extracting a fuse, the tool comprising:

a first bar having a jaw at a first end of the first bar;

a second bar slidably attached to the first bar and having a jaw at a first end of the second bar, wherein the respective jaws are adapted to align by sliding the respective bars relative to each other to retain the fuse between the jaws; and a jaw at a a second end of the first bar and a jaw at a second end of the second bar wherein the jaw at the second end of the second bar includes a groove.

112. The tool of claim 111, wherein the jaw of the first bar and the jaw of the second bar have arced profiles of substantially the same radii that are substantially equal to the radius of a fuse.

113. The tool of claim 112, wherein the arc length of the jaw of the first bar is one of greater than, less than, and equal to the arc length of the jaw of the second bar.

114. The tool of claim 111, wherein the arc length of the jaw at the second end of the second bar is one of greater than, less than, and equal to the arc length of the jaw at the second end of the first bar.

115. The tool of claim 111, wherein the jaw at the second end of the first bar and the jaw at the second end of the second bar are resilient.

116. The tool of claim 111, wherein the jaw of the first bar pivots about an axis that is perpendicular to the longitudinal axis of the first bar.

117. The tool of claim 111, further comprising a ball that rides between the first and second bars when respective bars slide relative to each other.

118. The tool of claim 117, wherein the ball rides a slot in one of the first and second bars when respective bars slide relative to each other.

119. The tool of claim 118, wherein the ball extends into a recess in the slot when the respective jaws are aligned, thereby locking the respective jaws in the aligned position.

120. A tool for installing and extracting a fuse, the tool comprising:

a first bar having a jaw at a first end of the first bar;

a second bar slidably attached to the first bar and having a jaw at a first end of the second bar, wherein the respective jaws are adapted to align by sliding the respective bars relative to each other to retain the fuse between the jaws; and a jaw at a a second end of the first bar and a jaw at a second end of the second bar wherein the jaw at the second end of the first bar and the jaw at the second end of the second bar are resilient.

121. The tool of claim 120, wherein the jaw of the first bar and the jaw of the second bar have arced profiles of substantially the same radii that are substantially equal to the radius of a fuse.

122. The tool of claim 121, wherein the arc length of the jaw of the first bar is one of greater than, less than, and equal to the arc length of the jaw of the second bar.

123. The tool of claim 120, wherein the arc length of the jaw at the second end of the second bar is one of greater than, less than, and equal to the arc length of the jaw at the second end of the first bar.

124. The tool of claim 120, wherein the jaw of the first bar pivots about an axis that is perpendicular to the longitudinal axis of the first bar.

125. The tool of claim 120, further comprising a ball that rides between the first and second bars when respective bars slide relative to each other.

126. The tool of claim 125, wherein the ball rides a slot in one of the first and second bars when respective bars slide relative to each other.

127. The tool of claim 126, wherein the ball extends into a recess in the slot when the respective jaws are aligned, thereby locking the respective jaws in the aligned position.

128. A tool for installing and extracting a fuse, the tool comprising:

a first bar having a jaw at a first end of the first bar;

a second bar slidably attached to the first bar and having a jaw at a first end of the second bar, wherein the respective jaws are adapted to align by sliding the respective bars relative to each other to retain the fuse between the jaws; and a ball that rides between the first and second bars when respective bars slide relative to each other.

129. The tool of claim 128, wherein the jaw of the first bar and the jaw of the second bar have arced profiles of substantially the same radii that are substantially equal to the radius of a fuse.

130. The tool of claim 129, wherein the arc length of the jaw of the first bar is one of greater than, less than, and equal to the arc length of the jaw of the second bar.

131. The tool of claim 128, further comprising a jaw at a second end of the first bar and a jaw at a second end of the second bar.

132. The tool of claim 131, wherein the arc length of the jaw at the second end of the second bar is one of greater than, less than, and equal to the arc length of the jaw at the second end of the first bar.

133. The tool of claim 128, wherein the jaw of the first bar pivots about an axis that is perpendicular to the longitudinal axis of the first bar.

134. The tool of claim 128, wherein the ball rides a slot in one of the first and second bars when respective bars slide relative to each other.

135. The tool of claim 134, wherein the ball extends into a recess in the slot when the respective jaws are aligned, thereby locking the respective jaws in the aligned position.

* * * * *